US005947582A

United States Patent [19]

Huang

[11] Patent Number: 5,947,582

[45] Date of Patent: Sep. 7, 1999

[54] FLOWER-SHAPED ORNAMENTAL LAMP

[75] Inventor: Peter K. H. Huang, Taipei, Taiwan

[73] Assignee: Shining Blick Enterprises Co., Ltd., Taipe, Taiwan

[21] Appl. No.: 09/130,459

[22] Filed: Aug. 7, 1998

[51] Int. Cl.[6] ..... F21P 1/02

[52] U.S. Cl. ..... 362/122; 362/806

[58] Field of Search ..... 362/122, 123, 362/805, 806, 431

[56] References Cited

U.S. PATENT DOCUMENTS 4,399,493 8/1983 Kurita et al. ..... 362/122

5,508,901 4/1996 Kuo ..... 362/806

*Primary Examiner*—Y. My Quach-Lee

*Attorney, Agent, or Firm*—Bacon & Thomas, PLLC

[57] ABSTRACT

A flower-shaped ornamental lamp includes a mount, an artificial flower, a flexible tubular stem connected between the mount and the artificial flower, a flexible supporting rod inserted through the flexible tubular stem and connected between the artificial flower and the mount, a bulb mounted on the artificial flower, and an electric wire inserted through the flexible tubular stem and connected to the bulb for providing power supply to the bulb.

2 Claims, 4 Drawing Sheets

FLOWER-SHAPED ORNAMENTAL LAMP

BACKGROUND OF THE INVENTION

The present invention relates to ornamental lamps, and more specifically to a flower-shaped ornamental lamp that has a flexible stem which may be conveniently bent by hand to the desired angle.

Conventional ornamental lamps commonly use a single electric wire to provide electricity to a set of bulbs. When electricity is provided to the bulbs, the bulbs are turned on to emit light. These ornamental lamps are less attractive. Recently, a variety of electronic control circuits have been disclosed for controlling ornamental lamps to produce different lighting effects. There are also known figured ornamental lamps. These figured ornamental lamps commonly comprises a figured lamp support, and a light emitting circuit assembly mounted in the figured lamp support. The figured lamp support shows the shape of a person (for example, Santa Claus), or an object (for example, a meteor). However, because the figured lamp support is of a fixed type, it cannot be adjusted to change the light emitting direction of the bulbs carried thereon.

SUMMARY OF THE INVENTION

According to one aspect of the present invention, the flower-shaped ornamental lamp is comprised of a mount, an artificial flower, a flexible tubular stem connected between the mount and the artificial flower, a flexible supporting rod inserted through the flexible tubular stem and connected between the artificial flower and the mount, a bulb mounted on the artificial flower, and an electric wire inserted through the flexible tubular stem and connected to the bulb for providing power supply to the bulb. The flexible tubular stem can be bent by hand to change the angular position of the artificial flower. According to another aspect of the present invention, the mount has a pointed anchoring rod for fastening to, for example, the earth.

DETAILED DESCRIPTION OF THE PREFERRED EMBODIMENT

Figure 1:
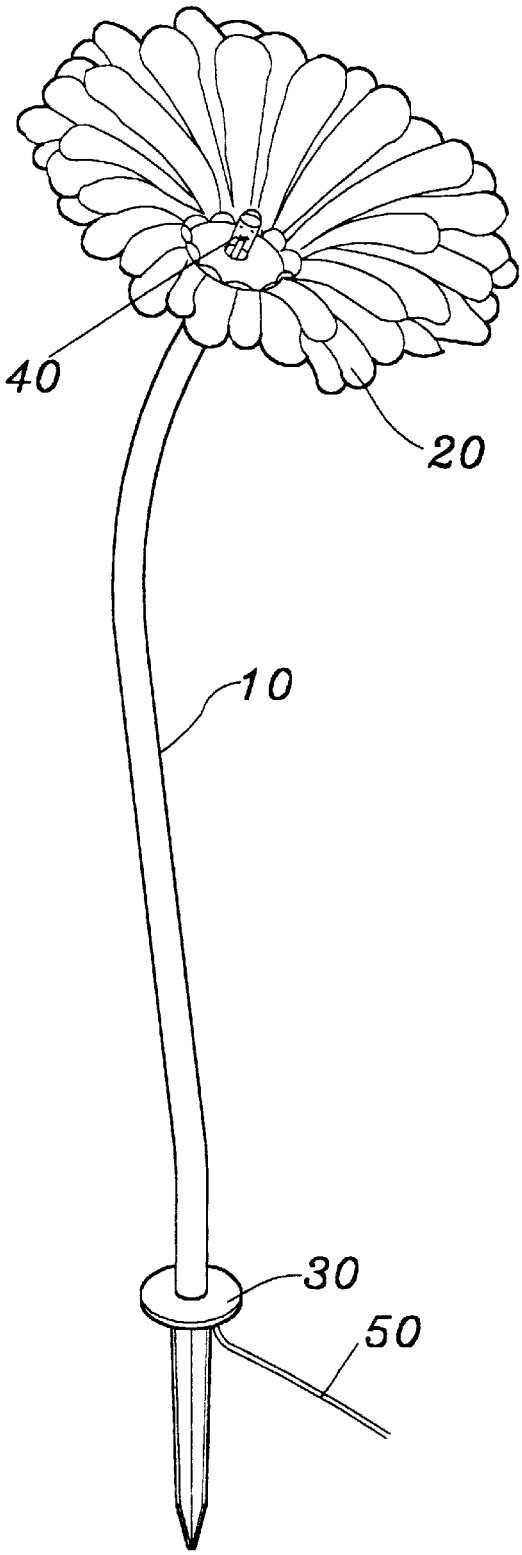
FIG. 1 is a perspective view of a flower-shaped ornamental lamp according to the present invention.

Referring to FIG. 1, a flower-shaped ornamental lamp in accordance with the present invention is generally comprised of a tubular stem 10, an artificial flower 20, a mount 30, and a bulb 40. The tubular stem 10 is injection-molded from a plastic material, having a bottom end fastened to the mount 30 and a top end connected to the artificial flower 20. The bulb 40 is mounted on the artificial flower 20 at the center thereof, and is electrically connected to an electric wire 50, which is inserted through the artificial flower 20, the tubular stem 10 and the mount 30.

Figure 2:
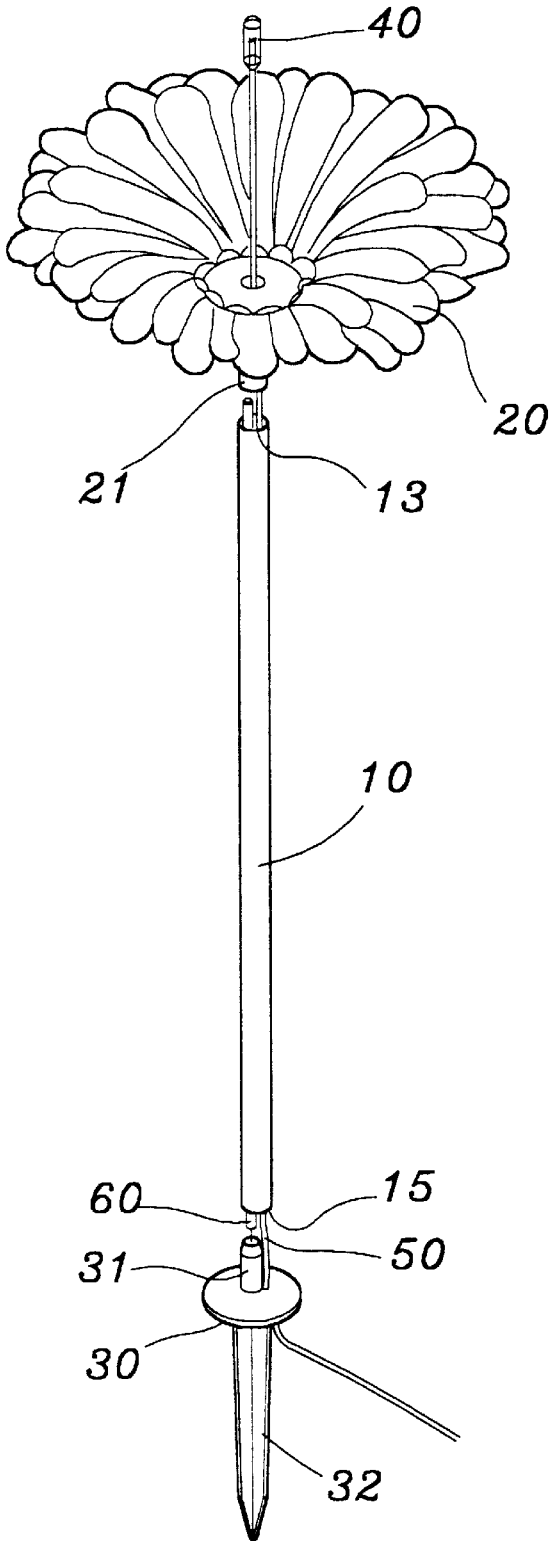
FIG. 2 is an exploded view of the flower-shaped ornamental lamp shown in FIG. 1.
Figures 3, 3A:
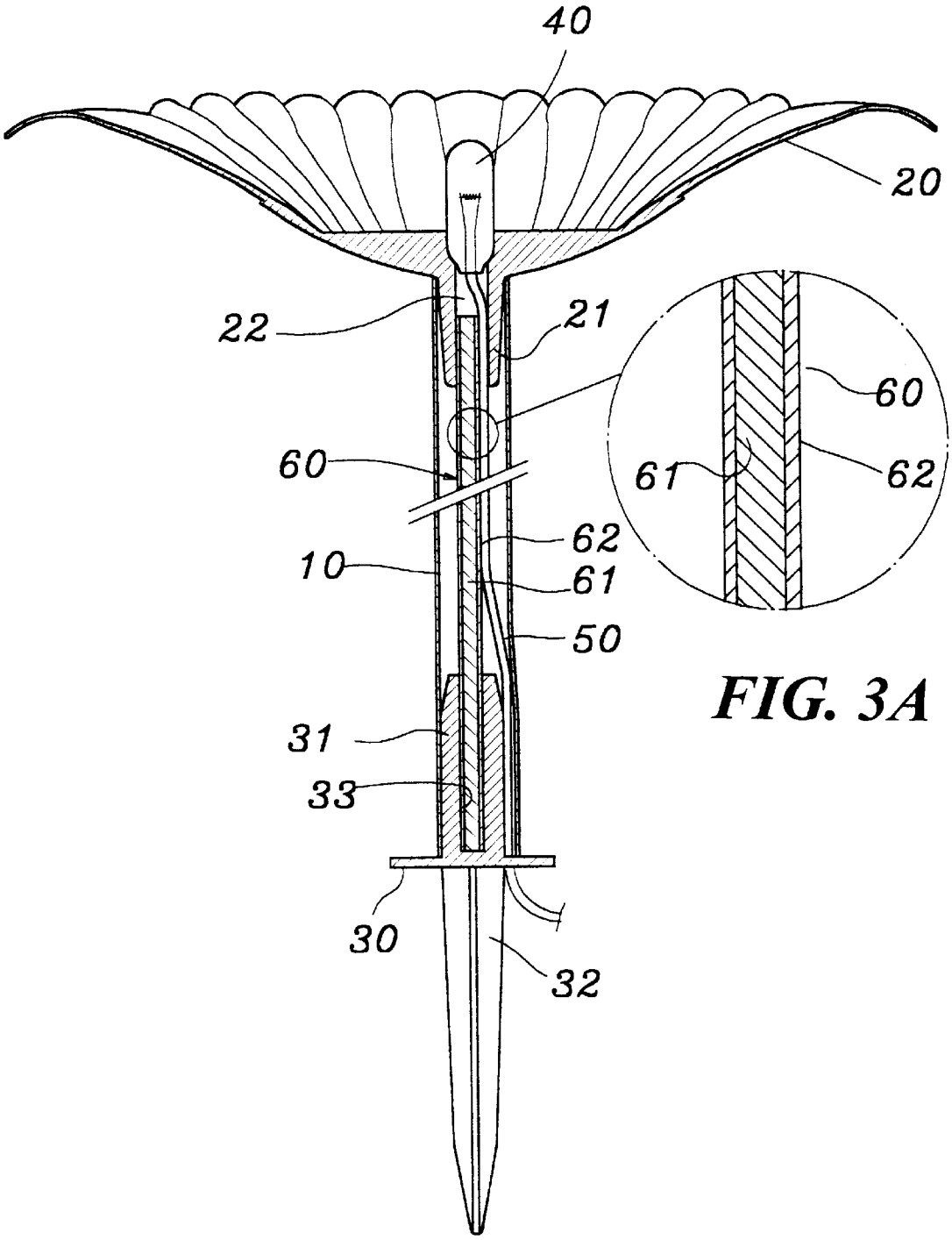
FIG. 3 is a sectional view of the present invention.
FIG. 3A is an enlarged view of a part of FIG. 3.

Referring to FIGS. 2 and 3, a flexible supporting rod 60 is longitudinally mounted inside the tubular stem 10. The artificial flower 20 has a stub rod 21 extending downwardly from the center of the bottom side thereof. The mount 30 comprises an upright coupling rod 31 raised from the flat, circular body thereof, and a pointed anchoring rod 32 extending downwardly from the center of the flat, circular body. The tubular stem 10 has a top end 13 sleeved onto the stub rod 21 of the artificial flower 20, and a bottom end 15 sleeved onto the upright coupling rod 31 of the mount 30. By means of the pointed anchoring rod 32, the ornamental lamp support can be fastened to the earth.

Referring to FIG. 3 again, the flexible supporting rod 60 is comprised of a metal wire 61, and an insulative layer 62 covered on the metal wire 61. The metal wire 61 has a proper diameter and high extensibility so that it can be easily bent into any desired shape. The stub rod 21 of the artificial flower 20 has a longitudinal center through hole 22. The upright coupling rod 31 of the mount 30 has a longitudinal center through hole 33. The two opposite ends of the metal wire 61 are respectively inserted into the longitudinal center through hole 22 on the stub rod 21 of the artificial flower 20 and the longitudinal center through hole 33 of the upright coupling rod 31 of the mount 30. The electric wire 50 is inserted through a hole on the flat, circular body of the mount 30 into the tubular stem 10 outside the upright coupling rod 31 of the mount 30, then inserted into the longitudinal center through hole 22 of the stub rod 21, and then connected to the bulb 40.

Figure 4:
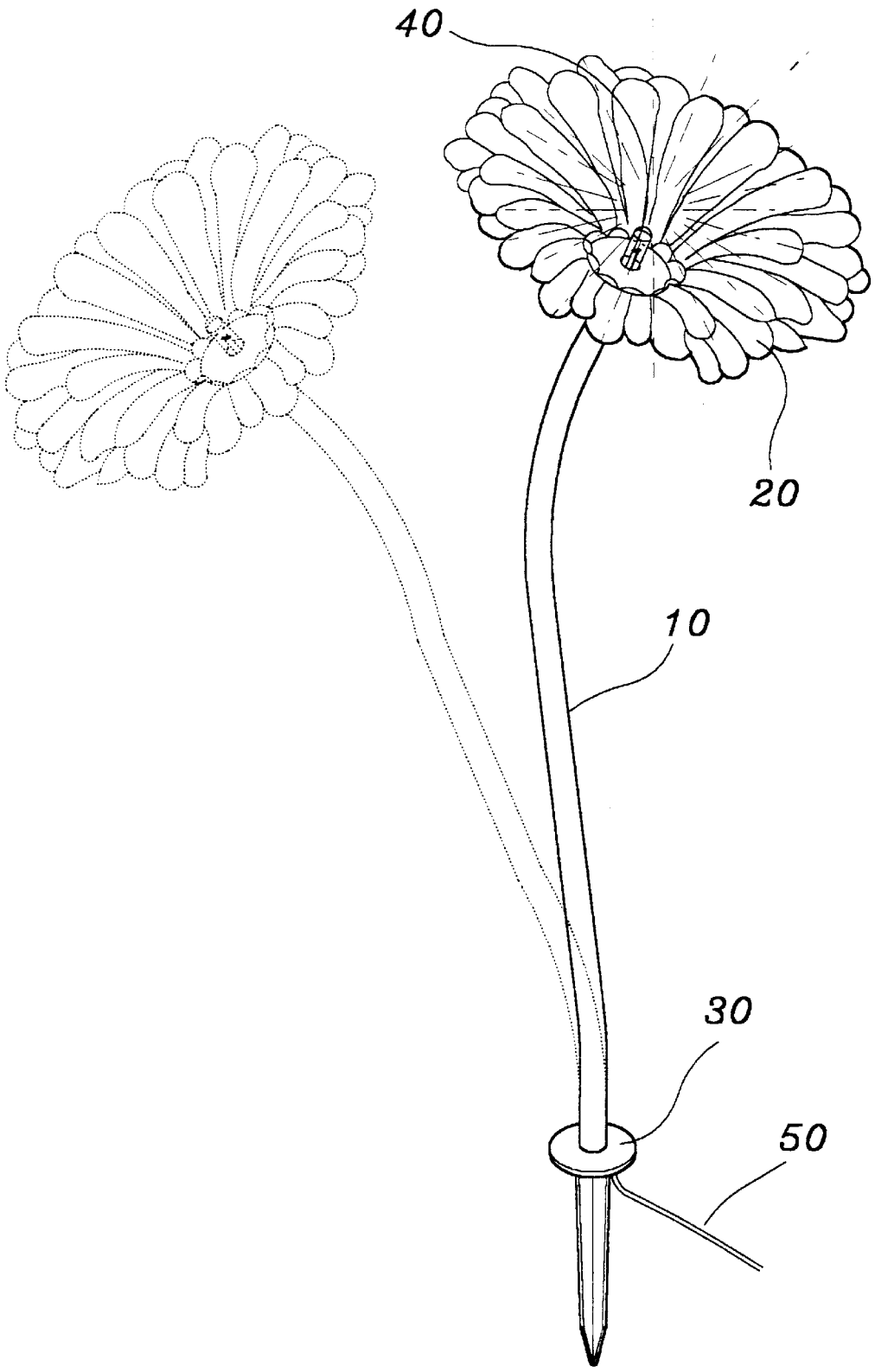
FIG. 4 is a view of the present invention, showing the tubular stem of the flower-shaped ornamental lamp bent to a different angle.

Referring to FIG. 4, when electricity is provided to the bulb 40, light from the bulb 40 is turned on to emit light. Further, the tubular stem 10 can be bent or curved to adjust the artificial flower 20 to the desired angle.

It is to be understood that the drawings are designed for purposes of illustration only, and are not intended as a definition of the limits and scope of the invention disclosed.

What the invention claimed is:

1. A flower-shaped ornamental lamp comprising:

a mount;

an artificial flower;

a flexible tubular stem connected between said mount and said artificial flower;

a flexible supporting rod inserted through said flexible tubular stem and connected between said artificial flower and said mount, said flexible supporting rod comprised of a flexible metal wire and an insulative layer covered on said flexible metal wire;

a bulb mounted on said artificial flower;

an electric wire inserted through said flexible tubular stem and connected to said bulb for providing power supply to said bulb; and wherein said artificial flower has a downwardly extended center stub rod defining a longitudinal center through hole, said mount has an upright coupling rod defining a longitudinal center through hole, said flexible tubular stem has a top end sleeved onto the downwardly extended center stub rod of said artificial flower and a bottom end sleeved onto the upright coupling rod of said mount, and said flexible supporting rod has a top end inserted into the longitudinal center through hole in the downwardly extended center stub rod of said artificial flower and a bottom end inserted into the longitudinal center through hole in the upright coupling rod of said mount.

2. The flower-shaped ornamental lamp of claim 1 wherein said electric wire has a top end inserted through the longitudinal center through hole in the downwardly extended center stub rod of said artificial flower and connected to said bulb, and a bottom end inserted through said flexible tubular stem and outside the longitudinal center through hole in the upright coupling rod of said mount.

* * * * *